US008946941B2

(12) United States Patent
Maughan et al.

(10) Patent No.: US 8,946,941 B2
(45) Date of Patent: Feb. 3, 2015

(54) WIRELESS POWER AND DATA TRANSFER DEVICE FOR HARSH AND EXTREME ENVIRONMENTS

(75) Inventors: Thomas G. Maughan, Carmel Valley, CA (US); William J. Kirkwood, Carmel, CA (US)

(73) Assignee: Monterey Bay Aquarium Research Institute, Moss Landing, CA (US)

( * ) Notice: Subject to any disclaimer, the term of this patent is extended or adjusted under 35 U.S.C. 154(b) by 571 days.

(21) Appl. No.: 13/424,530

(22) Filed: Mar. 20, 2012

(65) Prior Publication Data

US 2012/0175969 A1 Jul. 12, 2012

Related U.S. Application Data

(63) Continuation of application No. 13/232,674, filed on Sep. 14, 2011, now abandoned.

(60) Provisional application No. 61/403,335, filed on Sep. 14, 2010.

(51) Int. Cl.

| | |
|---|---|
| ***H01F 27/42*** | (2006.01) |
| ***H01F 37/00*** | (2006.01) |
| ***H01F 38/00*** | (2006.01) |

(52) U.S. Cl.

USPC ..... 307/104

(58) Field of Classification Search

USPC ..... 307/104

See application file for complete search history.

(56) References Cited

U.S. PATENT DOCUMENTS

| | | | | |
|---|---|---|---|---|
| 4,303,902 | A | 12/1981 | Lesster et al. | |
| 7,873,316 | B2 | 1/2011 | Rhodes et al. | |
| 2007/0297290 | A1 | 12/2007 | Vosburgh et al. | |
| 2010/0007214 | A1 * | 1/2010 | Howard et al. | 307/104 |
| 2010/0102915 | A1 | 4/2010 | Rhodes et al. | |
| 2010/0104031 | A1 | 4/2010 | Lacour | |
| 2010/0156193 | A1 | 6/2010 | Rhodes et al. | |

* cited by examiner

*Primary Examiner* — Carlos Amaya

(74) *Attorney, Agent, or Firm* — Lumen Patent Firm

(57) ABSTRACT

A wireless power and data connector includes a socket and a plug. The socket has a power port for connecting to a wired power transmission line, a data port for connecting to a wired data communication line, a wireless power transmitter, and a wireless data transceiver. The plug includes a power port for connecting to a wired instrument power transmission line, a data port for connecting to a wired instrument data communication line, a wireless power receiver, and a wireless data transceiver. The socket has a concave portion and the plug has a convex region shaped such that the convex region of the plug removably fits within the concave region of the socket. The wireless power transmitter and wireless power receiver transmit power from the socket to the plug using magnetically coupled resonant tank circuits.

1 Claim, 4 Drawing Sheets

WIRELESS POWER AND DATA TRANSFER DEVICE FOR HARSH AND EXTREME ENVIRONMENTS

CROSS-REFERENCE TO RELATED APPLICATIONS

This application is a continuation of U.S. patent application Ser. No. 13/232,674 filed Sep. 14, 2011 now abandoned, which claims priority from U.S. Provisional Patent Application No. 61/403,335 filed Sep. 14, 2010, both of which are incorporated herein by reference.

FIELD OF THE INVENTION

The present invention relates generally to wireless data and power transmission connector technology. More specifically, the invention relates to wireless transfer for data and power transmission in harsh environments such as under water.

BACKGROUND OF THE INVENTION

The need for an inexpensive and reliable method of sub-sea connection is well established. That need is growing with the advent of continuous ocean presence programs such as the Ocean Observing Initiative (OOI) and similar projects around the world. Maintenance operations typically involve removal and replacement of scientific instruments and sensors. Accordingly, there is need for a 'wet mate-able' connector as the alternative is to pull up the entire system, which is cost prohibitive.

SUMMARY OF THE INVENTION

The use of wireless (sometimes referred to as contactless) power transmission coupled with wireless data transfer and a design that is constructed for continuous long term operation with fault tolerance and fault recovery enables a solution that meets the requirements. Providing a solution that works in, around and deep beneath the sea also enables a product that can be useful in other harsh environments such as chemical processing plants, waste water treatment facilities, oil and gas industry, etc.

A specific example for use in deep ocean scientific equipment connected to a cabled observatory is shown to illustrate usage.

In this instance, the Monterey Accelerated Research Station provides a power and communications node 42 km from shore and at a depth of 900 m. Science experiments are attached to the node using wet mate-able connectors. Deployment durations and continuous operation can be many years with maintenance required several times per year for instrument maintenance and calibration.

Maintenance of science instrumentation motivated the wireless power and data connector design described herein as a way to change out instrumentation without the need to recover the entire experiment platform. The wireless power and data connector reduces cost, provides galvanic isolation to avoid ground faults and improves reliability by eliminating corrosion of metallic contacts.

One embodiment of invention includes a primary unit, hereafter referred to as the 'socket' and a secondary unit, here-after referred to as the 'plug'.

The socket has wired connection ports for connecting to power and data sources from a system. The socket transfers power wirelessly through alternating magnetic field to the plug by a closed loop controlled resonant tank circuit. Wireless transmit and receive for bi-directional data is implemented by circuitry and either optical or radio frequency means as detailed below that is independent of the power transfer path. The plug has a wireless power receiver and wireless receive and transmit for bi-directional data for the connection to the socket. The plug provides a wired connection to a device connected to a system.

An array of sockets, analogous to a power strip, are packaged to share the same power input wire as a means to minimize associated cabling and connectors thus reducing overall system cost for the end user. The design provides support for a variety of data connections such as (and not limited to) point to point RS232 serial data, multi-drop connections such as RS485, CAN-bus, and Ethernet. Connectivity options such as USB, as well as wireless protocols brought in by wire such as Bluetooth and 802.11 are also scoped into the design.

Both the socket and plug are packaged in materials that suit the application environment. These materials have the following properties: 1) highly resistant to corrosive liquids, 2) able to withstand sustained high pressures of 'full ocean depth', 3) anti-static, and 4) wear resistant.

The plug is shaped to facilitate using a gloved hand or robotic manipulator to plug/unplug in-situ. A specially designed handle to provide strain relief and off axis force decoupling as well as a machine grip-able surface is a key feature of the plug. Typical usage in the ocean is for a remotely operative vehicle (ROV) or a deep submersible manned-sub which has a manipulator that is controlled by a pilot using a camera and a set of controls. In shallower water, a diver would unplug an instrument and plug in a replacement unit. Both plug and socket have visible light indicators to provide feedback to the human operator on the status of the connection. The socket is designed to allow detritus and debris to be cleared by the action of inserting and removing the plug.

Power is transmitted from the socket to the plug by means of magnetically coupled resonant tank circuits. Frequency is adjusted in a manner similar to resonant dc/dc converter designs as a means to regulate output voltage. Feedback on output voltage for the purpose of output voltage regulation is transmitted from socket to plug by multiple paths to insure fault tolerance and fault recovery. The voltage feedback is sent digitally by either a) modulating a waveform on the power receive coil and demodulating at the socket by a circuit connected to the power transmit coil, b) sending feedback voltage digitally via software protocol interleaved onto the data transfer channel.

The magnetic circuit is designed to be flexible and adaptable to a variety of physical setups and conditions. The combination of magnetic design, electronics and software control also create a system that is capable of adapting to conditions such as aging or fouling as they change through time. The transfer path of the magnetic field operates across gaps between transmitter and receiver ranging from 0 to over 0.25", tolerating various gaseous, liquid, and non-magnetic solid materials in the gap.

Planar coils, dissected toroid, and c-core are supported by the adaptable electronics and software. The choice of magnetic media is determined by the maximum power and size of the connector assembly. For planar coils, magnetic material is used as a backing to route the flux lines and minimize radiated magnetic noise.

The transmit and receive magnetics are designed to produce a variety of plugs providing output voltages or sets of multiple voltages appropriate for the instrument or sensor attached by adjusting turns ratios on the receiver coil as well as by secondary dc/dc conversion. The plug output(s) are galvanically isolated from the power input to the socket. This part of the design enables voltage configuration of the plug at manufacturing time. A procedure for use during the custom plug design cycle and for use during manufacturing is used to tune the receiver coil to match the transmitter by using a software algorithm to compute the corresponding capacitance to provide the quality factor and resonant frequency to match a standardized transmitter frequency. This procedure involves using a specially programmed socket and plug set that is used to provide test, measurement and diagnostic information about the electrical parameters of the magnetic circuit. First the plug magnetic are measured with an inductance meter and using the resonant frequency of the socket, a capacitance value for the plug is calculated from the frequency and the plug inductance plus first order empirical correction factor. With the plug inserted into a standardized socket magnetic circuit, a program running on the socket that uses dynamic measurements of voltage and current from both the socket and plug, a calculation is performed that determines the capacitance for the serial resonant circuit. The value of the trim capacitor necessary to modify the capacitance loaded into the circuit is also calculated so that the calculated values can be verified by re-running the procedure. The plug electronics contains a circuit used to provide an electrical load. This is load is used in the tuning algorithm and also used to determine the power quality before enabling power transfer to the attached instrument when the plug is inserted.

The data transfer portion is a full duplex (bi-directional) connection using a separate path, independent of the from the power transfer circuit. Data transfer in the design is accomplished by optical and/or by radio frequency transfer. In the case of optical, separate paths are provided for transmit and receive. For fault tolerance and fault recovery, the optical paths are each capable of operating in half-duplex and able to provide both transmit and receive in the event of a failure or blockage on one of the optical channels. The optical data provides a secure data path by a) mechanical shielding to block radiated optical emissions, and b) through an encryption scheme on both the transmitted and received data. In the case of radio frequency transfer, transmit and receive is accomplished by adapting standard radio transceiver integrated circuits to an antenna design optimized for short haul communications across the gap between socket and plug and capable of operating in the presence of flammable, conductive, acidic or caustic solutions as well as in air.

Both Socket and Plug have non-volatile data storage for quality of service information, fault diagnostic information, efficiency measurement, aging assessment data, test data set storage, instrument/sensor metadata and calibration information, and instrument data logging (configurable between circular or fixed record storage).

DETAILED DESCRIPTION

The following description of the details of preferred embodiments of the system are organized by mechanical, magnetic, electrical and software aspects.

Mechanical

Figure 1:
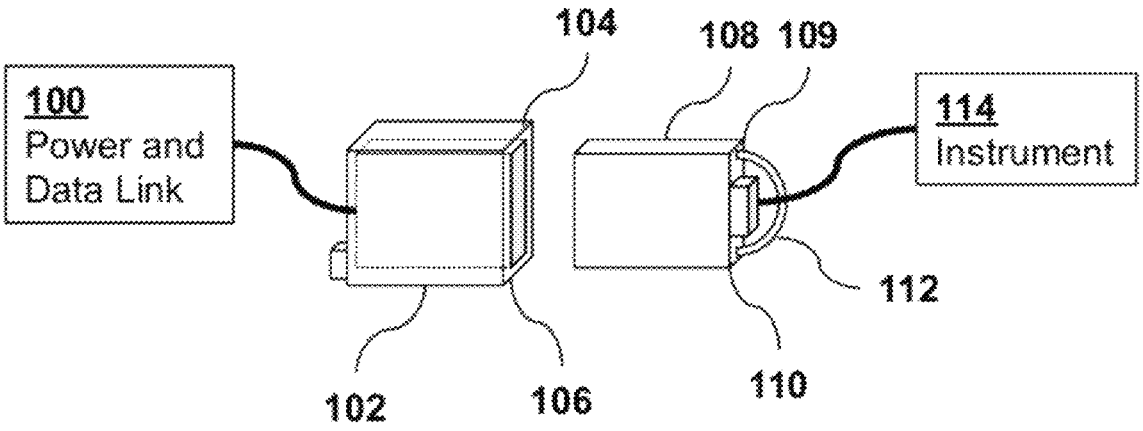
FIG. 1: Paddle plug and socket configuration of a wireless power and data connector, according to an embodiment of the invention.
Figure 2:
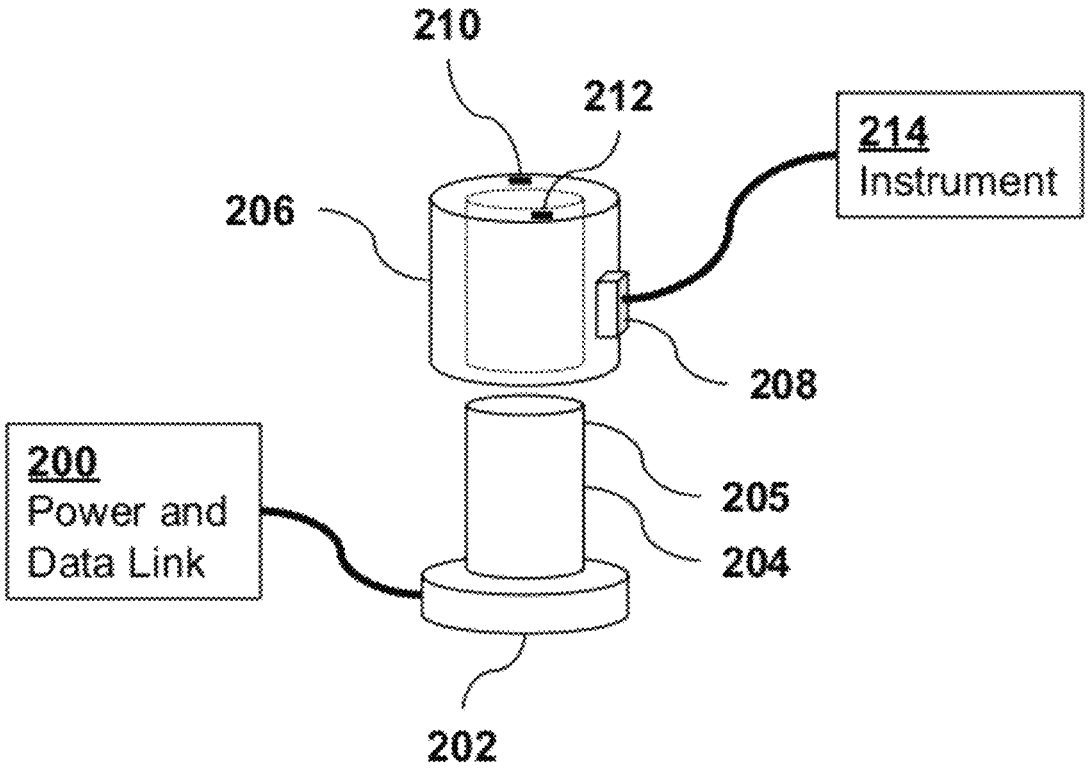
FIG. 2: Cylinder plug and mating socket configuration of a wireless power and data connector, according to an embodiment of the invention.

Various package options adaptable to magnetic and electronic circuit options and end applications are foreseen. The first designs to be reduced to practice are a paddle style plug and mating socket (FIG. 1) and a concentric cylinder plug and mating socket (FIG. 2). The paddle style design shown in FIG. 1 has a socket 102 connected to a power and data link 100, and a plug 108 connected to an instrument 114. Socket 102 has a power indicator 104 and data indicator 106. Similarly, plug 108 has a power indicator 109 and data indicator 110. The cylindrical style design shown in FIG. 2 has a socket composed of a puck element 202 containing electronics and a resonant transformer core 204 and data transfer section 205. A mating plug is composed of a puck element and electronics 208 and a data transfer section 206 having resonant transformer winding. The plug also has a power indicator 210 and data indicator 212. Puck element 208 connects the plug to an instrument 214. Similarly, puck element 202 connects the socket to a power and data link 200.

The geometry and mating of the socket and plug unit is designed so as to minimize radiated electromagnetic, acoustic, and/or optical noise.

Multiple sockets can be packaged like a power strip to further reduce cost and complexity by sharing power and communications cabling.

A handle 112 on the plug 108 is designed so that remotely operated vehicles and machines as well as divers with a gloved hand can plug/unplug the plug from the socket. Flexible materials are used to decouple off axis loading by a remotely operated vehicle manipulator.

Magnetic

Magnetics design and configuration provides loose tolerance on distance between coils and adaptability to various materials between coils including sea water. The techniques of resonant tank circuit power coupling are well established with a patent history that dates back to the late 1890's with Nikola Tesla.

Electrical

Figure 3A:
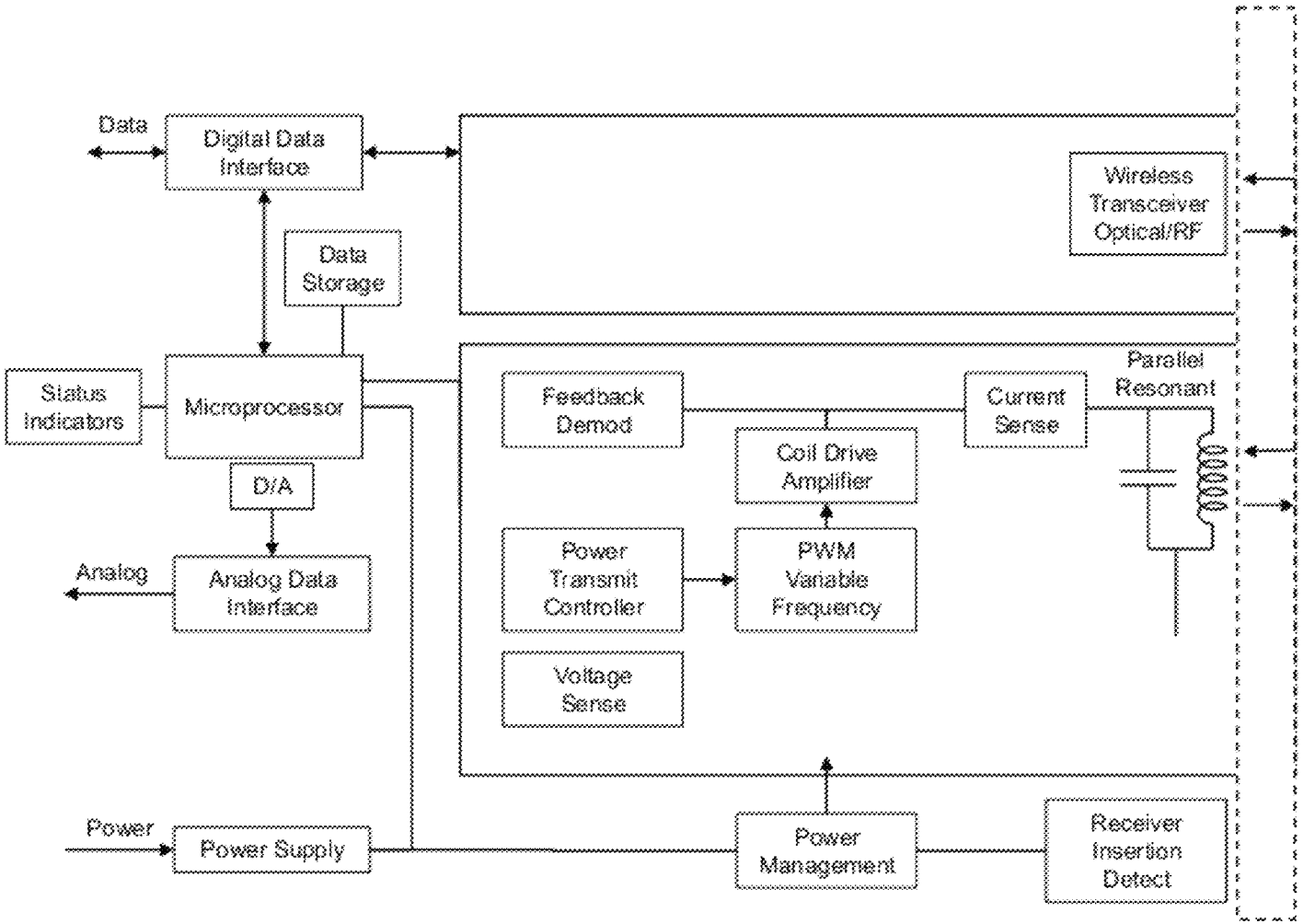
FIGS. 3A-B: Block diagram of a wireless power and data connector, according to an embodiment of the invention.
Figure 3B:
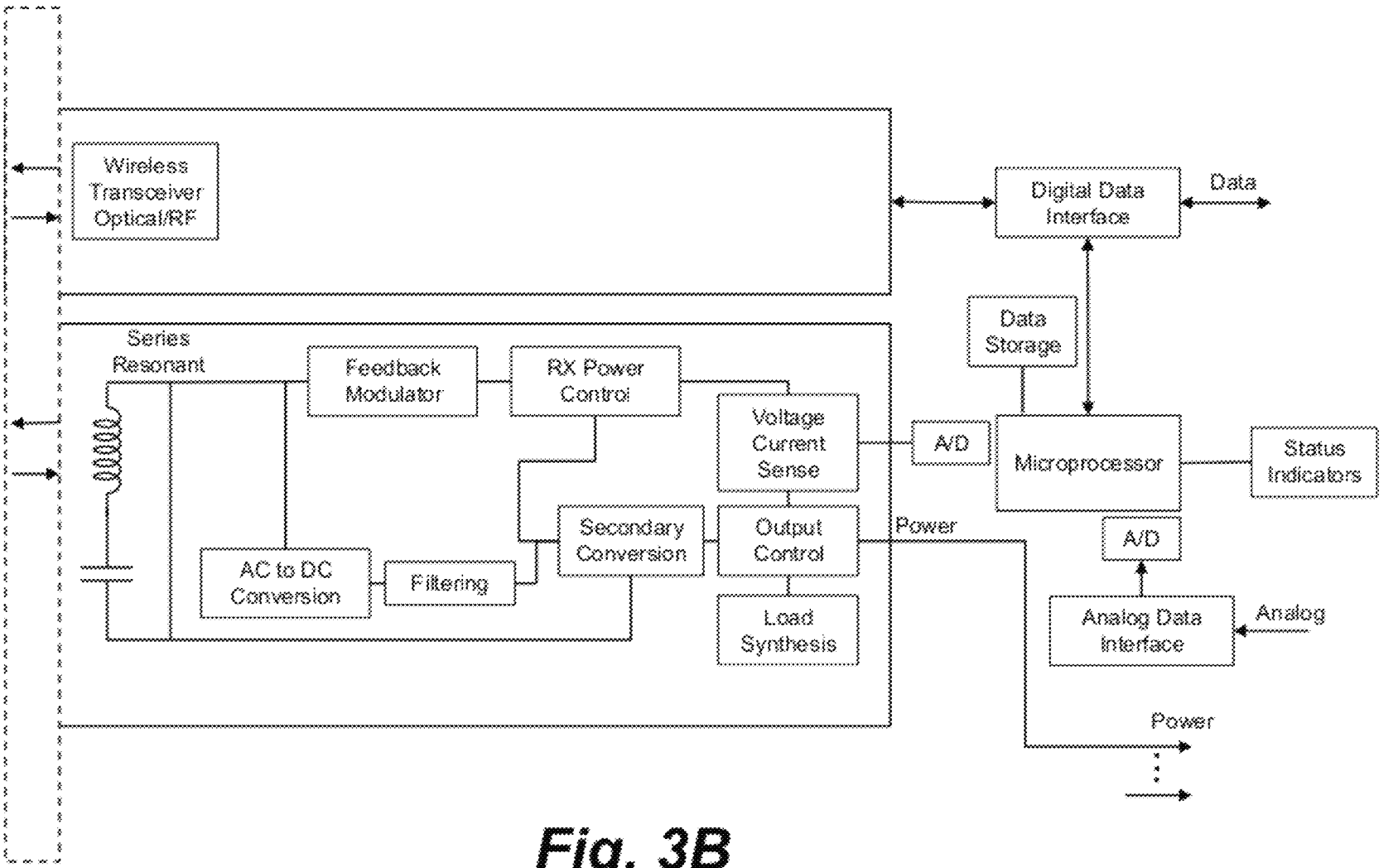

FIGS. 3A-B illustrate electrical details of the wireless power and data connector, with the socket side shown in FIG. 3A and the plug side shown in FIG. 3B.

Socket Details

'Socket power supply' converts wired input direct current using switching power supply techniques coupled with linear regulation to create supply voltages for the logic and control circuits, data transceiver circuits and the inductive power transmit circuit.

'Socket Power management' circuit provides logic circuitry to turn off portions of the socket circuitry in order to reduce power consumption and radiated noise in the absence of a plug 'Socket plug insertion detector' circuitry activates the socket power management circuit which then supplies power to the micro-processor subsystem, power transmitter subsystem and data transceiver subsystem.

'Socket analog data' circuitry converts digital data that has been received from the plug into an analog signal. Control signals from the microprocessor set the output gain of a digitally controlled programmable gain amplifier. The output voltage is scaled and sampled by an A/D converter and a software algorithm is used to process meta-data transferred from the plug to the socket through the data transceiver to properly scale the gain and offset of the analog output voltage to correspond to the plug input analog range.

'Socket digital data interface' includes voltage level translators, for example but not limited to RS232, RS485, and/or CANbus, to a logic level signal for interfacing to the microprocessor and the wireless data transceiver circuitry.

'Socket microprocessor subsystem' provides the status and control functionality driven by software programs that implement algorithms for fault detection and fault recovery, data encryption and decryption, data integrity algorithms including error detection and correction, data logging, operational statistics and system status, drives visible light status indicator state, sends and receives control, meta-data, calibration, operation configuration and status to/from the plug. The Socket has software programs and circuitry for the digital to analog reconstruction algorithms for the analog data interface. The socket microprocessor subsystem is also used to run programs to enable self-test and manufacturing validation and configuration programs for adapting to various magnetic circuit components. The software algorithms are described in the section below under software.

'Socket status indicators' have circuitry to convert logic signals from the microprocessor to drive the visible status indicators used by operators to determine proper operation or fault status. Color and flashing on and off provide the visual feedback. The LED circuit is driven from port bits of the microprocessor.

'Socket data storage' includes serial flash EEPROM storage available to the processor for storing meta-data, calibration information, manufacturing information, data logging, and user define-able data.

'Socket wireless transceiver' includes circuitry for transmitting and receiving bidirectional serial data streams. Two means are provided, optical and radio frequency (RF) transceivers.

The 'socket optical transceiver' includes circuitry to drive an infrared or visible light emitting diode (LED) for transmission and an infrared or visible light detector and amplifying circuit for receiving. A redundant set of transmit/receive pairs are implemented to insure a means for fault recovery in the event of occlusion by contamination. Each channel can operate in half-duplex bi-directional or as a dedicated Receive or Transmit channel. This flexibility is managed by fault tolerance and recovery algorithms running on the microprocessor.

The 'socket RF transceiver' includes circuitry for modulating and demodulating bi-directional serial data streams on a low power radio frequency carrier frequency through a subminiature antenna. Programmable transmit power is used for tuning and adapting to various media for wireless data between socket and plug. In practice there a number of commercially available integrated circuits that implement that functional block diagram of a radio transceiver. The CC1150 is used in the first implementation of the invention. The antenna design is unique to this invention as it optimizes the transmission and reception of near H-Field propagation of the RF signal. Notch, slot or loop antenna configurations are claimed with a loop implemented at 433 MHz for the first implementation. The loop antenna implemented as a loop of conductor on a printed circuit board is shown with impedance matching transformer, second smaller loop, and surface mount capacitor to cancel the loop inductance.

Data security for the digital stream is accomplished through software encryption and decryption algorithms running on the microprocessor and operating on the serial data stream as is done in the optical communication path.

Socket Wireless Power Transmitter Subsystem

'Power transmit controller' and pulse width modulator (PWM) with variable frequency. Commercially available microprocessor with PWM output capability is used in conjunction with a software algorithm to control the frequency based on demodulated feedback data sent from the plug.

'Feedback data demodulator' is a circuit for extracting a digital signal imposed across the electromagnetic circuit used for power transfer. This signal is used by the plug to control the transmit frequency of the socket.

Plug sends increase or decrease control signals by tone encode scheme and the socket decodes the tones and using software to control the socket electronics provides voltage output control of the plug by changing the drive frequency and/or percentage of pulse width modulation according to a software algorithm running on the socket microprocessor subsystem.

The invention can also make use of commercially available devices that provide non-proprietary means for transmit and receive power control by using Wireless Power Consortium compliant devices.

'Coil driver amplifier' includes a set of push pull power MOSFETs with gate drive electronics. The Power transmit controller drives the coil drive amplifier circuit with a PWM signal of a frequency which scans the frequency range of the Q factor of the coupled resonant transmit and receive circuit. Software control of the frequency and pulse width duty cycle is controlled by the plug to regulate the output voltage at the plug.

'Parallel Resonant Circuit' is the circuit topology used in the socket for power transmission. In the simplest form it is an inductor and capacitor (LC) in parallel that form a resonant tank circuit and are configured to transmit electromagnetic energy from the socket that couples into a series resonant tank circuit in the plug. The resonant frequency and quality factor (Q) are set to match between transmit and receive circuits. The socket parallel tank circuit provides a standardized frequency and power band. This invention can utilize LLC parallel resonant tank circuits and zero power switching techniques for higher power implementations.

Plug Details

'Plug Wireless Power Receiver Subsystem' includes a series resonant circuit tuned to match the transmitter parallel resonant frequency and quality factor (Q). Rectification is performed by diode bridge rectification or active synchronous rectification with filtering capacitors. A linear regulator forms the power supply for the logic and controller circuits. Voltage and current are sensed by circuitry and converted from analog to digital for feedback control of the transmitter frequency of the socket. The receive power controller implements software algorithms and with modulation circuitry consisting of a resistor or capacitor coupled with a switch controlled by the power controller to create a pulse width and tone used by the plug to control the socket frequency. An algorithm running on the receive power controller manages a portion of the boot up sequence executed when a plug is first inserted in a socket that involves the use of a synthetic active load to verify the integrity of power transfer before the energy is switched to the attached device. The plug wireless power receiver subsystem could also optionally be implemented using devices and design techniques with compliant frequency, coil design and feedback signaling with the Wireless Power Consortium specification.

Operator notification of the integrity of the plug and socket wireless connection is accomplished through the use of pulse sequences of light emitting diodes.

'Active Load synthesis circuit' is comprised of a low-side MOSFET with integrated protection logic connected to a load resistor that represents double the intended operating power load of the plug. A pulse width modulation (PWM) signal is used to then adjust the load by varying the duty cycle. 2 R Load would be 0.5 ohm for a plug designed to provide 5v at 1 A (5 W). For robustness, the plug is conservatively designed to provide at least 30% more power than rated and the resistor is designed to insure the active load can test the full capability of the power transfer.

Output control circuitry is implemented using an intelligent high side switch controlled by the plug control microprocessor. The output is enabled immediately following the disable of the active synthetic load.

'Plug analog data interface' circuitry converts analog signals into digital data that is then transmitted through the data communications channel (optical or radio frequency). Metadata recorded into the data storage portion of the plug at manufacturing time that describes the signal range and offset that is communicated from the plug to the socket at the time of plug power on in order to configure and calibrate the socket analog output to the correct gain.

Plug digital data interface to the instrument provides standardized serial interfaces such as, but not limited to, RS232, RS485, CANbus, and Ethernet.

The Open Geospatial Consortium (OGC) standard PUCK protocol, is also supported in addition to the pass through serial protocols for instrument communications. Refer to http://www.opengeospatial.org/projects/groups/puck1.0swg for information on PUCK.

'Plug micro processor' provides a means to run software algorithms and programs. The plug micro processor samples the voltage and current and calculates the efficiency of the transformer and uses the control tones and pulse width control capabilities of the socket to implement closed loop control of the plug output voltage by directing the socket to change frequency and pulse width through commands sent by default through the modulation of power receive circuit parameters. In the event of a noisy or degraded feedback path through the power magnetic, feedback information can be sent by interleaving in the serial data stream through the data connection (optical or RF). The fault detection and recovery capability is implemented by having redundant paths for information and software running on the plug and socket microprocessors.

Operator feedback on plug insertion is provided by 'plug status indicators'. In the initial implementation, these indicators are provided by one or more light emitting diodes and a technique for blinking a pattern to inform the operator of plug integrity.

'Plug data storage' includes serial flash EEPROM storage available to the processor for storing meta-data, calibration information, manufacturing information, data logging, and user define-able data. A region of the data store is allocated to support the Open Geospatial Consortium (OGC) PUCK protocol.

'Plug wireless transceiver' includes the same functionality as the circuitry in the socket with mechanical layout to insure emitter and detector alignment in the case of the optical data communication option or radio frequency antenna alignment in the case of the RF transceiver.

Software

Plug Insertion, Power Up Software Process.

The socket is inactive until the plug is inserted. The socket plug insert detection circuit activates the power supply to the logic, power control, and microprocessor in the socket. The socket software activates the power control system and starts with a nominal frequency driven out through the power transmit circuit at the lower end of the resonant frequency response curve. The socket processor then begins to sweep the frequency up to higher frequencies while reading status bits used as indications from the feedback demodulator circuit that the plug processor has been powered up and is activated. A signaling protocol is used to synchronize software state machines running on both the socket and plug processors. Once the socket processor software has detected the presence of signaling from the plug, the socket processor stops increasing the transmit frequency. The next state in the process is for the plug to take control of the frequency sweep of the socket by modulating the control signals across to the socket to increase (or decrease) the frequency in order to produce the desired output voltage. After a stable output voltage is achieved the plug sends control information to the socket to decrease the duty cycle by approximately 20% while adjusting the frequency to restore the output voltage to the stable operating state. An output load and voltage value, determined at manufacturing time and stored in the plug, is read from the plug data storage. These values are then fed into a software loop which incrementally adjusts the duty cycle of the PWM output to the plug synthesized active load, while adjusting the frequency output of the socket power transmitter by sending modulated feedback control to the socket until the desired output voltage is produced at the given load value. The next state is to adjust the PWM driving the synthesized load to zero and then enable the plug output power switch to provide the output voltage to the instrument wired to the plug. The next state is voltage regulation loop to keep the output voltage stable. Voltage regulation is accomplished by sending feedback control to the socket to adjust the duty cycle of the PWM frequency when the regulation increment is small or the frequency when the regulation increment is large.

Software Process For Secure Data Transfer and Encryption and Decryption Method.

Serial data stream input to the socket is read into the socket processor and an encryption algorithm is performed on the data stream which is then packed into a transport packet that has a checksum for error detection by the plug processor. The same encryption and decryption scheme is used for data transferred the other direction, from the plug to the socket. At the core of the encryption process is a key that is created by the plug that is transferred to the socket after the power coupling is achieved. This key is used in a calculation both for encryption and decryption for data sent from socket to plug and plug to socket through the data communications path.

The packetized transport mechanism uses a cyclic redundancy check coding scheme to determine communication errors. Errors will cause the operator LEDs to flash a pattern that is documented to mean communication error. Packet retries are used to recover from errors. If the optical communications path is available, when the error rate reaches a predetermined threshold, there are command packets sent from socket to plug to identify which channel is problematic and to switch to a half-duplex use of the channel with the least errors.

The invention claimed is:

1. A wireless power and data connector comprising a socket and a plug;

wherein the socket comprises:

a power port for connecting to a wired power transmission line;

a data port for connecting to a wired data communication line;

a wireless power transmitter;

a wireless data transceiver;

wherein the plug comprises:

a power port for connecting to a wired instrument power transmission line;

a data port for connecting to a wired instrument data communication line;

a wireless power receiver;

a wireless data transceiver;

wherein the socket has a concave portion and the plug has a convex region shaped such that the convex region of the plug removably and fits within the concave region of the socket;

wherein the wireless power transmitter and wireless power receiver transmit power from the socket to the plug using magnetically coupled resonant tank circuits.

* * * * *